United States Patent [19]

Kasai et al.

[11] Patent Number: 5,015,812

[45] Date of Patent: May 14, 1991

[54] OVEN WITH AN EXHAUST OPENING FOR COLLECTING VAPORS TO CONTROL MATERIAL HEATING

[75] Inventors: Isao Kasai, Nabari; Kimiaki Yamaguchi, Nara; Shinichi Sakai, Yamatokoriyama; Susumu Murakami, Nara; Tatsuji Isono, Nabari; Toyotsugu Hatagawa, Yamatokoriyama, all of Japan

[73] Assignee: Matsushita Electric Industrial Co., Ltd., Osaka, Japan

[21] Appl. No.: 509,783

[22] Filed: Apr. 17, 1990

[30] Foreign Application Priority Data

Apr. 19, 1989 [JP] Japan ..... 1-099413

[51] Int. Cl.[5] ..... H05B 6/68

[52] U.S. Cl. ..... 219/10.55 B; 219/10.55 E; 219/490; 219/400; 99/325

[58] Field of Search ..... 219/10.55 B, 10.55 R, 219/10.55 E, 460, 490, 504; 99/325; 126/21 A, 21 R

[56] References Cited

U.S. PATENT DOCUMENTS

| | | | |
|---|---|---|---|
| 4,508,947 | 4/1985 | Eke | 219/10.55 B |
| 4,587,393 | 5/1986 | Ueda | 219/10.55 B |
| 4,618,756 | 10/1986 | Schwaderer et al. | 219/10.55 R |
| 4,841,111 | 6/1989 | Kokkeler et al. | 219/10.55 B |
| 4,857,685 | 8/1989 | Vigano et al. | 219/10.55 E |

FOREIGN PATENT DOCUMENTS

| | | |
|---|---|---|
| 58-127017 | 7/1983 | Japan . |
| 59-191813 | 10/1984 | Japan . |

*Primary Examiner*—Phillip H. Leung
*Attorney, Agent, or Firm*—Spencer & Frank

[57] ABSTRACT

A cooking heating apparatus has a vapor sensor for sensing the state of heating of food in a heating chamber, thus performing automatic control of the heating operation. An auxiliary exhaust opening for allowing vapor from the heated food to be introduced to the vapor sensor is formed in a region where the flow of the vapor is not influenced by a main flow of air supplied into the heating chamber and flowing towards a main exhaust opening. The vapor sensor is disposed so as to be exposed to the vapor introduced through the auxiliary exhaust opening. The condition of the vapor is therefore sensed quickly without being influenced by the main flow of air.

12 Claims, 10 Drawing Sheets

OVEN WITH AN EXHAUST OPENING FOR COLLECTING VAPORS TO CONTROL MATERIAL HEATING

BACKGROUND OF THE INVENTION

1. Field of the Invention

The present invention relates to a heating apparatus which is capable of sensing, by means of a vapor sensor, the state of gas or vapor generated from a heated substance in accordance with the state of heating, so as to automatically determine the timing of completion of heating of the substance, thereby optimizing the heating operation.

2. Description of the Related Art

A known heating apparatus for heating a material in a heating chamber has a sensor capable of sensing a change in the state of vapor generated from the heated material. In this known heating apparatus, air is introduced from the heating chamber and is then returned into the heating chamber through a return air passage. The sensor is disposed in this return air passage.

This type of heating apparatus is disclosed, for example, in Japanese Patent Unexamined Publication Nos 59-191813 and 58-127017. In the apparatus disclosed in these publications, a sensor is provided, rather than an exhaust passage for ventilating the heating chamber, in a return passage through which air that has been extracted from the heating chamber through an extracting passage is returned to the heating chamber. According to this arrangement, the vapor generated from the heated material is sensed substantially in the same heated state as that of the heated material without being cooled. This arrangement, however, has a drawback in that sensing errors may occur.

Namely, if the position of the opening of the return passage opening to the heating chamber is not precisely determined in relation to the opening for introducing air from the heating chamber to the outside, the vapor generated by the heated material is undesirably mixed with chilled air from an air supply opening before the vapor is introduced into the heating chamber from the return passage, resulting in that the temperature of the vapor is lowered to impede the automatic control of the heating operation.

Problems are encountered even when the opening of the return passage is precisely located. The vapor is recycled between the heating chamber and the return passage. In the beginning period of the vapor generation, the sensing of the vapor by the sensor is conducted relatively easily because the concentration of the vapor is increased. However, when the quantity of the vapor is decreased due to the stopping of heating or when the heating has been suspended to prepare for the next heating cycle, detections of the change in the heating state tend to be delayed due to stagnation of the vapor.

SUMMARY OF THE INVENTION

Accordingly, an object of the present invention is to provide a heating apparatus which effectively prevents the vapor from being diluted or cooled by the air supplied into the heating chamber and which can quickly sense any increase or decrease in the amount of vapor caused by a change in the state of heating of the heated material, thus enabling the state of the heated material to be sensed without delay, thereby realizing good finish of the heated material, such as foodstuff.

According to the present invention, the heating chamber which is provided with an exhaust opening (first exhaust opening) is provided with an auxiliary exhaust opening (second exhaust opening), and the steam sensor is provided in communication with this second exhaust opening.

The positions of the air supply opening, first exhaust opening and the second exhaust opening are determined so as to prevent the flow of vapor from the heated material towards the second exhaust opening from being disturbed by air from the air supply opening to the first exhaust opening.

Therefore, the vapor from the heated material before entering the second exhaust opening is not mixed with cold air flowing from the air supply opening to the first exhaust opening, so that the temperature of the heated material can be sensed without delay by the vapor sensor. Stagnation of the steam in the steam sensor is prevented because the steam sensor is provided in communication with the second exhaust opening unlike the known heating apparatus in which the steam sensor is provided in the return passage, so that the sensor can sense any change in the state of heating without delay.

DESCRIPTION OF THE PREFERRED EMBODIMENTS

Figure 1:
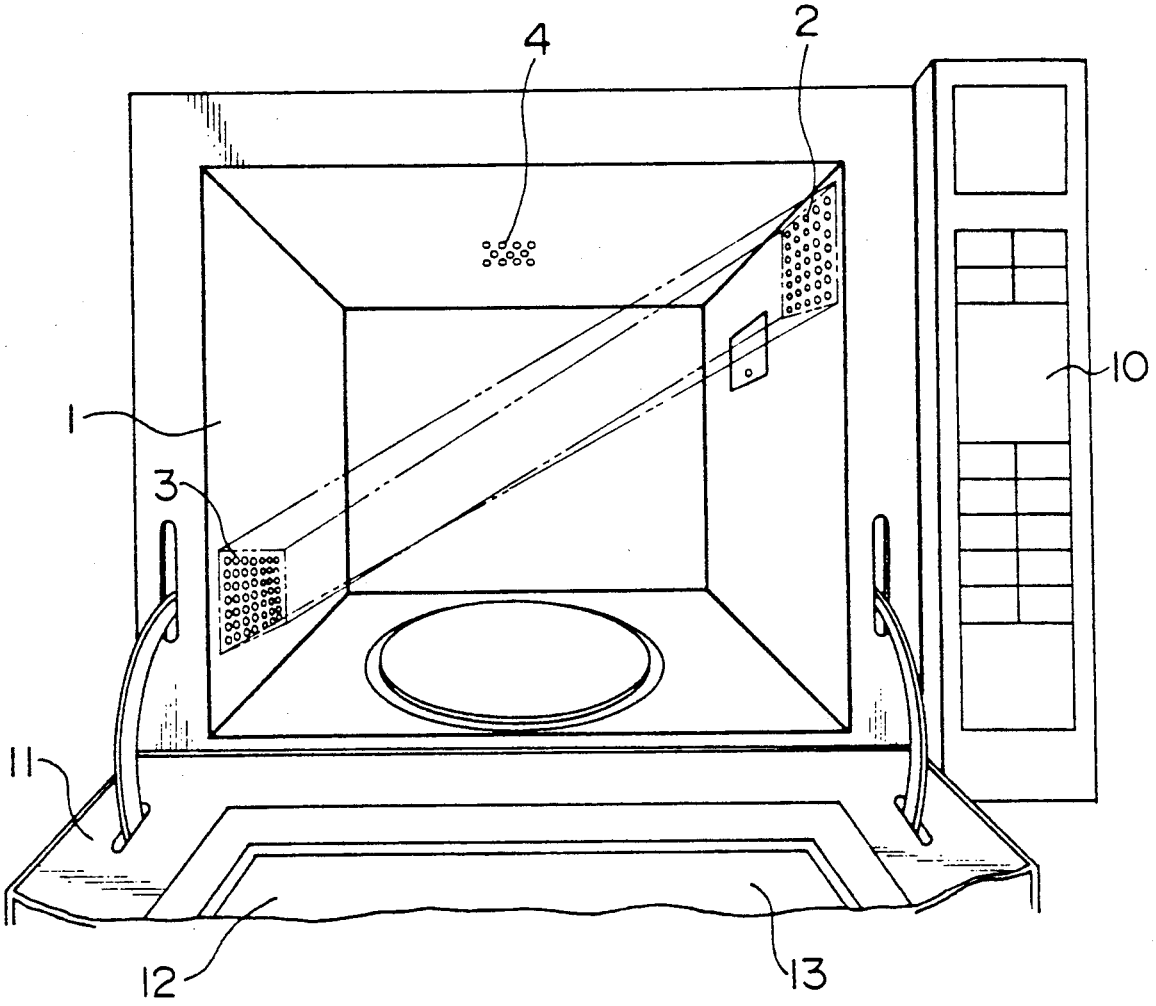
FIG. 1 is an enlarged elevational view of an embodiment of the automatic heating apparatus of the present invention.

Referring to FIG. 1, an embodiment of the heating apparatus in accordance with the present invention has a heating chamber 1 which is opened at its front side. A door 11 is attached to the front side of the apparatus to open and close the heating chamber 1. An air supply opening 2 is formed in a wall of the heating chamber 1 which is on the right-hand side as viewed in FIG. 1, at an upper portion of this wall near the door 11. A first exhaust opening 3 is formed in a wall of the heating chamber 1 which is on the left-hand side as viewed in FIG. 1, at a lower portion of this wall near the door 11. A second exhaust opening 4 is formed in a top wall of the heating chamber substantially at the center of the top wall. Thus, the second exhaust opening 4 is disposed at a level above the levels of the air supply opening 2 and the first exhaust opening 3. The first exhaust opening 3 has an area greater than that of the second exhaust opening 4. The first exhaust opening 3 is disposed at a level below that of the air supply opening 2. The second exhaust opening 4 can be disposed at the same level as that of the air supply opening 2. The air supplied through the air supply opening 2 flows along a wall of the heating chamber and along a window 12 and is then deflected at the juncture between this wall and the next wall so as to flow along the next wall. This flow of air is discharged to the outside of the heating chamber through the first exhaust opening 3. The second exhaust opening 4 is formed in a wall surface of the heating chamber which is not reached by the above-mentioned flow of air and which opposes the wall along which the above-mentioned flow of air is formed, or in the top wall of the heating chamber as illustrated.

Figure 2:
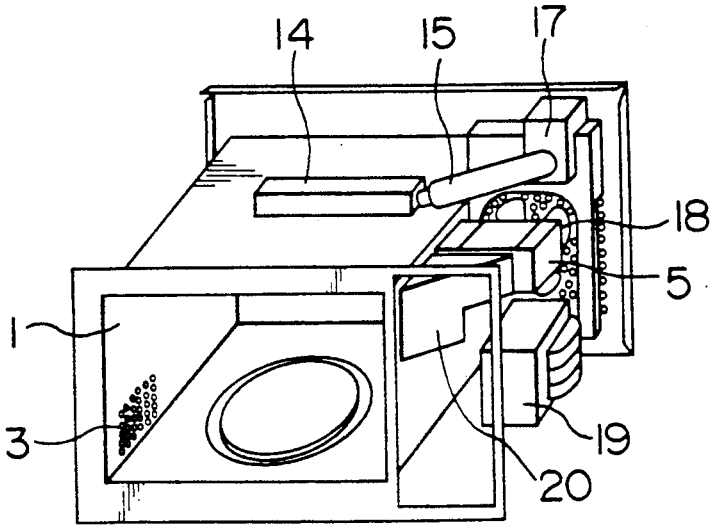
FIG. 2 is a perspective view of the internal structure of the embodiment shown in FIG. 1.

Referring to FIG. 2, the door 11 and a control panel 10 of the apparatus have been removed to show the internal structure, in particular the first exhaust opening 3. Vapor generated form the heated material enters the second exhaust opening 4 and is guided by a second exhaust guide 14, a vent pipe 15, a first exhaust guide 16 (refer to FIG. 3) and a second exhaust guide 17, so as to be discharged to the exterior after making contact with a heat-sensitive surface of a vapor sensor. The supply of air through the air supply opening 2 is effected by a cooling blower 18 as air supply means which is disposed behind a room in which electrical components are disposed. The air introduced by the blower 18 cools a high-voltage transformer 19 and a magnetron 5 or heating means and is guided to the air supply opening 2 of the heating chamber 1 via heat-radiating fins of the magnetron 5.

Figure 3:
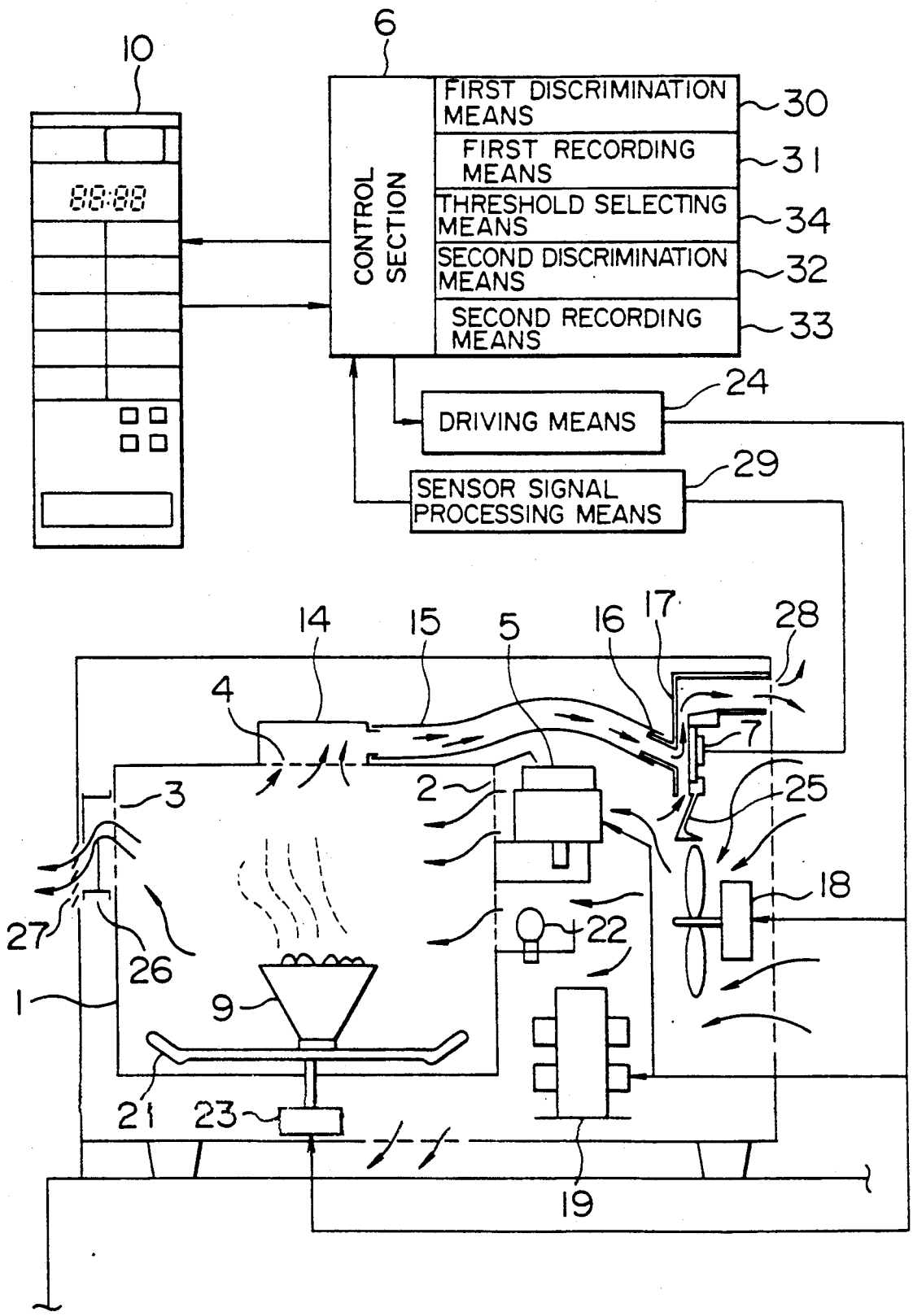
FIG. 3 is a schematic block diagram components illustrating of the embodiment shown in FIG. 1.

FIG. 3 is a schematic block diagram illustrating the operations of the components, shown in FIG. 2, of the apparatus which is shown in a cross-sectional view. A turntable 21 for mounting a heated material 9 is provided in the center of the heating chamber 1. The magnetron 5 or heating means, which heats the material 9 by being supplied with a high-frequency electric power, as well as a lamp 22 for illuminating the material 9, is provided on a wall of the heating chamber 1. The turntable 21 mounting the material 9 is rotated by a turntable motor 23 the operation of which is controlled by the output signal from a driving means 24. The turntable 21 is rotated during heating of the material 9. The high-voltage transformer 19 for supplying high voltage to the magnetron 5 also is controlled by the output signal from the drive means 24. Thus, the magnetron 5 or the heating means is indirectly controlled by the driving means 24. The cooling fan motor 18 also is controlled by the output signal from the driving means 24 so as to supply air for cooling the magnetron 5, the lamp 22 and the high-voltage transformer 19. The air introduced into the heating chamber 1 serves also as conveying means for conveying vapor generated from the heated material to the outside of the apparatus. The high-voltage transformer 19, the cooling blower 18 and the turntable motor 23 are controlled by the driving means 24 which in turn is controlled by control signals delivered from a control unit 6.

An orifice member 25 provided in the vicinity of the cooling blower 18 is adapted to control the flow rate and direction of the air blown by the blower 18.

The air supplied by the blower 18 into the heating chamber 1 carries the vapor generated from the heated material 9. Two separate exhaust passages are available for this air. That is, a first exhaust passage extends from the first exhaust opening 3 to a first discharge opening 27 via a first exhaust guide 26, and a second exhaust passage extends from the second exhaust opening 4 to a second discharge opening 28 via the second exhaust guide 14, the vent pipe 15, the first exhaust guide 16 and the second exhaust guide 17. A pyroelectric vapor sensor 7 is disposed such that its heat-sensitive surface is exposed to the second exhaust passage.

Thus, the vapor from the heated material 9 is sucked and discharged also from the second exhaust opening 4 to the second exhaust opening 28. A portion of cold and dry air blown from the cooling blower 18 and restricted by the orifice member 25, vigorously flows into the second exhaust passage through a small orifice formed in the second exhaust guide 17 adjacent to the heat-sensitive surface of the vapor sensor 7 provided on the inner wall surface of the second exhaust guide 17. That is, the cold air fed through the orifice member 25 and the orifice in the second exhaust guide 17 flows by way of the heat-sensitive surface port of the vapor sensor 7 where the cross-sectional area of the flow passage is increased. This cold air, released into the second exhaust passage having the increased cross-sectional area, is discharged to the outside of the apparatus via the second exhaust guide 17 and the discharge opening 28. This vigorous flow of air causes the pressure of air on the heat-sensitive surface of the vapor sensor 7 to be reduced to a level lower than that of the air pressure in the heating chamber 1, resulting in a sucking of the vapor from the heating chamber 1 to the vapor sensor 7. Thus, the second exhaust passage is provided with a sucking means which includes a small orifice port across which the cross-sectional area of the passage for the cold and dry air from the cooling blower 18 is largely changed to generate a reduced pressure on the heat-sensitive surface of the vapor sensor 7. The passage leading from the second exhaust opening 4 is connected to the region where the above-mentioned large change in the cross-sectional area of air passage occurs. Thus, the air from the passage which serves as the sucking means and the vapor from the passage leading from the second exhaust opening 4 are mixed together and the mixed gas is discharged to the outside of the apparatus through the second discharge opening 28 after making contact with the heat-sensitive surface of the steam sensor 7.

A brief explanation of pyroelectricity will now be made. When the surface of dielectric member has been charged due to internal polarization and the member is irradiated with a heat carried by light, infrared radiation, a vapor or the like, the internal polarization of the dielectric member is extinguished by an instantaneous change in the temperature of the dielectric member so that charges remain only on the surface of the dielectric member. This condition gives the pyroelectricity. It is possible to utilize the charges remaining on the surface by connecting this dielectric member to an electrical circuit. This type of element is generally referred to as "pyroelectric element". Thus, a pyroelectric element produces a signal voltage only when a change in the temperature has taken place. When the temperature of the pyroelectric element is raised almost to the same level as the temperature of the vapor, the vapor no more causes a temperature change of the pyroelectric element, so that any change in the state of the heated material 9 cannot be detected any more.

The vapor sensor 7 used in this embodiment incorporates a pyroelectric element. When heat possessed by the vapor generated from the heated material 9 is transmitted to the heat-sensitive surface, a rapid temperature rise is caused in a portion of the element so that a thermal impact is given to the element to cause a disturbance in the polarized equilibrium state in the element, thereby creating an abrupt change in the voltage, i.e., a voltage pulse, on the surface of the element. This pulse signal also is produced when the heat-sensitive surface which has been heated is quickly cooled due to making contact with the cold air. In this case, however, the polarity of the voltage pulse is inverse to that of the voltage pulse generated when the pyroelectric element is heated.

The sensing signal from the vapor sensor 7 is delivered to a sensor signal processing means 29. The sensor signal processing means 29 includes a low-pass filter circuit, a high-pass filter circuit and a signal voltage amplifier circuit which process the sensor signal to produce pulse signals which are delivered to the control unit 6.

The control unit 6 operates in accordance with input signals delivered from a keyboard of the control panel 10 so as to deliver a display output to the control panel 10 and output signals to the driving means 24 thereby operating the magnetron 5 to heat the material 9 and rotating the turntable 21.

When a sensor signal from the vapor sensor 7 is delivered to the control unit 6 through the sensor signal processing means 29, a content discriminated by first discrimination means 30 within a first predetermined time after the start of heating is recorded in a first recording means 31. A threshold selecting means 34 in the control unit 6 has a storage table and computing formulae for selecting a plurality of threshold values in accordance with a content recorded in the first recording means 31. A second discrimination means 32 of the control unit discriminates the sensor signal which is delivered from the sensor signal processing means 29 when the first predetermined time has elapsed after the start of heating so as to confirm the signal voltage and to measure the quantity of the signal. A second recording means 33 in the control unit 6 records the sensing signal voltage and the quantity of the signals discriminated and confirmed by the second discrimination means 32.

In the control unit 6, the sensing signal voltage and the quantity of the sensing signal recorded in the second recording means are compared with threshold values which are selected by the threshold selecting means 34 in accordance with the content of the sensor signal from the first recording means 31, thus evaluating the state of heating of the heated material 9. The control unit 6 then determines whether the heating is to be continued or is to be stopped followed by display of termination of heating, and produces a control signal indicating whether the heating is to be continued or stopped.

Figure 4A:
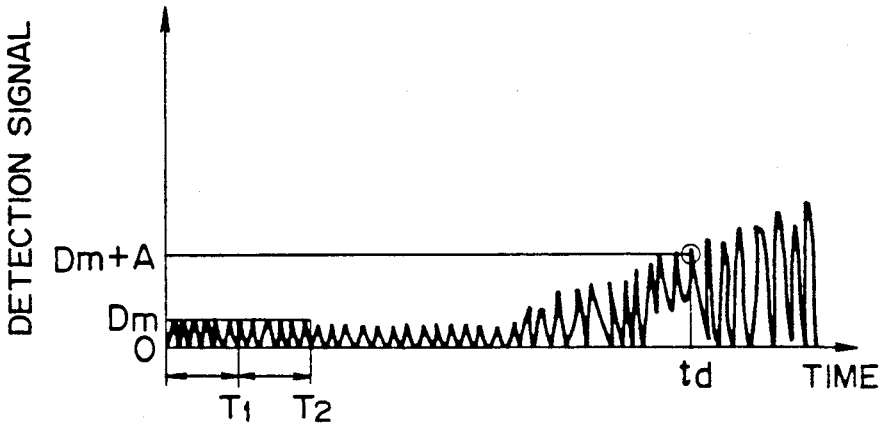
FIGS. 4*a* to 4*c* are charts showing a change in a vapor sensor signal in relation to time as observed in the embodiment shown in FIG. 1.

FIG. 4*a* shows how the level of the sensor signal from the vapor sensor 7 is changed in relation to time. More specifically, the axis of ordinate represents the level of the sensing voltage signal while the axis of abscissa represents the time elapsed. Within a first predetermined time between a moment $T_1$ and a moment $T_2$, the first discrimination means 30 reads the maximum value Dm of the sensor output level as a sensing signal level. This value Dm is recorded in the recording means 31. The threshold selection means 34 then selects one from a plurality of threshold values in accordance with the value Dm recorded in the first recording means 31. These threshold values are selected, for example, in accordance with one of the conditions 1 and 2 shown in the following Table I.

TABLE I

| First recorded content Dm | Condition 1 Threshold | Condition 2 Threshold |
|---|---|---|
| $a < Dm \leqq b$ | Dm + A | Dm + A |
| $b < Dm \leqq c$ | Dm + B | Dm × B |
| $c < Dm \leqq d$ | Dm + C | Dm × B + C |

In this table, A, B, C, a, b, c and d represent constants. Explanation will be made of the condition 1.

Figure 4B:
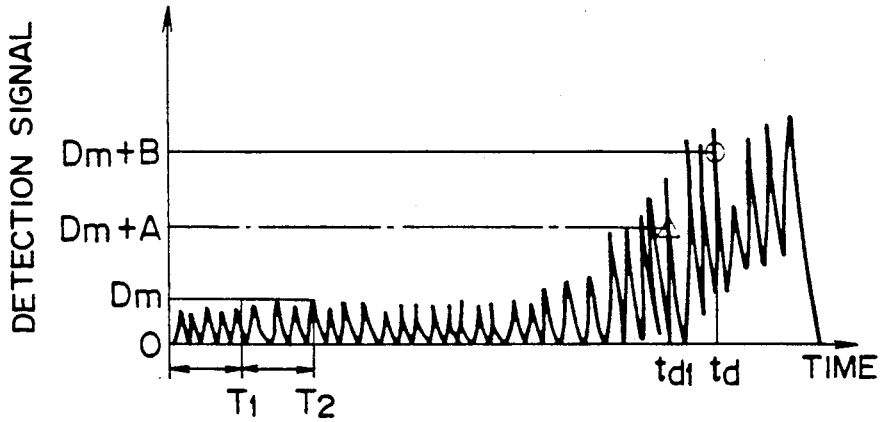
Figure 4C:
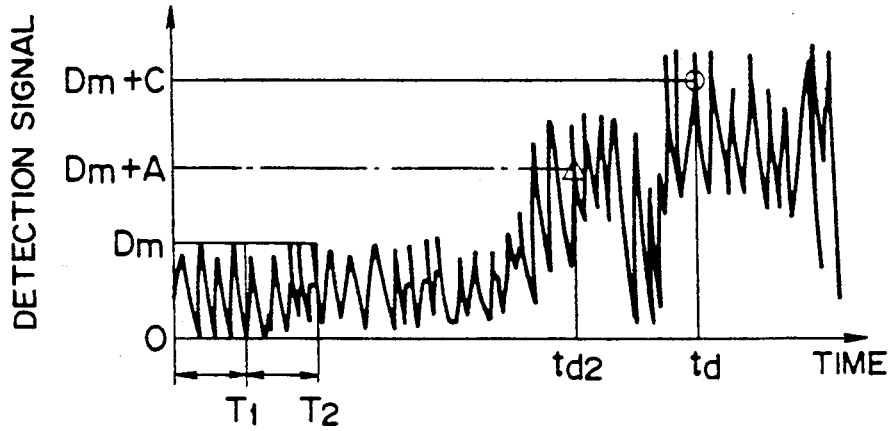

According to the condition 1, three constants A, B and C are added to Dm as threshold-setting constants. A sensing time $t_d$ for sensing the vapor from the heated material 9 is determined as a result of the setting of the threshold values. FIGS. 4*a*, 4*b* and 4*c* show, respectively, the cases where the total sensitivity of the apparatus is low, medium and high. It will be seen that the fluctuation of the sensing time $t_d$ is very small, despite a large fluctuation of the sensitivity of the apparatus. In FIGS. 4(*b*) and 4(*c*), $t_{d1}$ and $t_{d2}$ indicate the SenSing time when the same constant is added to the first recorded content Dm despite a larger fluctuation in the sensitivity of the apparatus. It will be seen that these sensing times $t_{d1}$ and $t_{d2}$ are largely offset from the sensing time $t_d$ as shown in FIG. 4(*a*). Thus, when the same sensing method as that applied to the case where the sensitivity is low, i.e., the condition of FIG. 4(*a*), is applied to the cases where the sensitivity is medium and high, i.e., which to are shown in FIGS. 4(*b*) and 4(*c*), the sensing time is shortened as indicated by $t_{d1}$ and $t_{d2}$, respectively, with the result that the heating time for heating the material 9 is shortened. Thus, upon application of the same sensing procedure, the sensing time is shortened when the sensitivity is high as compared with the case where the sensitivity is low, with the result that the time for heating the material 9 is shortened.

The second discrimination means 32 discriminates whether the level of the sensing signal has reached any one of the plurality of threshold values set by the threshold selecting means 34. Namely, in a period after the moment $T_2$, the second discrimination means 32 measures the number of sensor signals which have exceeded the threshold level and this number is recorded in the second recording means. The moment at which the number recorded in the second recording means has reached a value which is greater than a predetermined number, e.g., 5, of pulse signals is recorded as the time $t_d$ which is the time when the signal derived from the vapor indicates that the material 9 has been heated to a moderate state.

The sensing time $t_d$, which is determined by the state of heating of the material 9, is thus obtained. This means that the material 9 has been adequately heated by the time $t_d$ so that the heating may be stopped without any risk of imperfect heating. Taking into account any fluctuation of, for example, the mass of the material 9, however, it is preferred that the heating is continued for a while, considering that the time $t_d$ is the time at which the generation of vapor has just commenced. It is therefore preferred to set an additional heating time which is determined by multiplying the time $t_d$ with a suitable constant.

Figure 5:
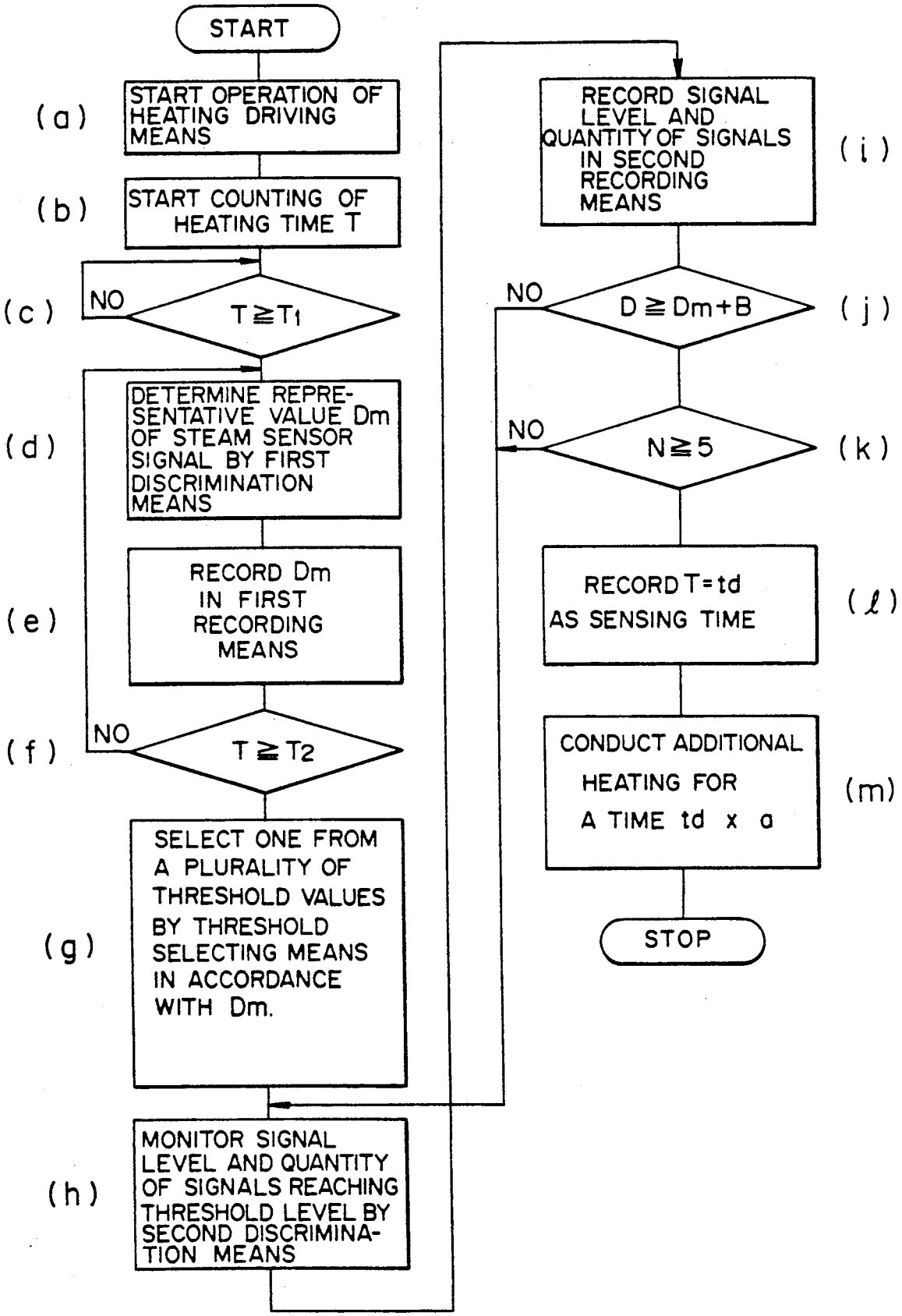
FIG. 5 is a flow chart showing the operation of the embodiment shown in FIG. 1.

FIG. 5 is a flow chart of a heating operation performed by the illustrated embodiment. The process is commenced by setting the material 9 in the heating chamber 1 and inputting a heating start instruction through the keyboard after selection of a heating menu.

In Step (a), a control signal is issued from the control unit 6 so that the magnetron 5, the transformer 19, the cooling blower 18 and the turn-table motor 23 are activated through the driving means 24. In Step (b), the control unit 6 starts counting the heating time T. In Step (c), the process is held on until the time T reaches a predetermined time $T_1$. In Step (d), a maximum value Dmax of the sensor signal from the vapor sensor 7 is determined as the representative signal level Dm. In Step (e), the representative level Dm is stored in the first recording means 31. The steps (d) and (e) are executed repeatedly until the first predetermined time is over. In Step (g), one of the threshold selecting conditions, e.g., Dm +B, is selected by the threshold selecting means 34 in accordance with the representative value Dm of the vapor sensor signal. In Step (h), when the first predetermined time is over, the second discrimination means 32 discriminates the value D of the sensor signal level and the number N of the signals. In Step (i), the sensor signal level D and the number N of the signals are recorded in the second recording means 33. The steps (h) and (i) are repeated until Step (j) determines that the sensor signal level D has reached the signal level selected by the threshold selecting means 34. In Step (k), Steps (h), (i) and (j) are repeatedly executed until the number N of the signals exceeding the threshold level reaches 5 (five). In Step (1), the time td is recorded as the time for sensing change in the sensor signal indicative of the moderately heated state of the object 9. In Step (m), additional heating is conducted for a period determined by multiplying the time $t_d$ with the factor $\alpha$, and the heating is then completed.

A description will now be given of the vapor sensor 7 with specific reference to FIGS. 6 to 7. The pyroelectric element produces a signal voltage due to a disturbance of equilibrium of the internal polarization state caused by an abrupt change in temperature, as explained before. A certain type of pyroelectric elements also has piezoelectric characteristics. The pyroelectric element used in the invention may be a piezoelectric ceramic element such as a piezoelectric buzzer or a supersonic vibrator.

Figure 6:
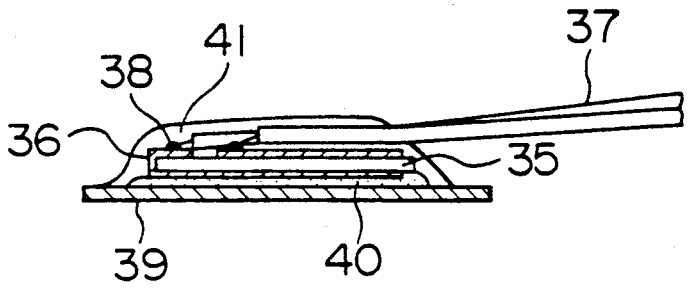
FIG. 6 is a sectional view of a part used in the embodiment shown in FIG. 1.
Figure 7:
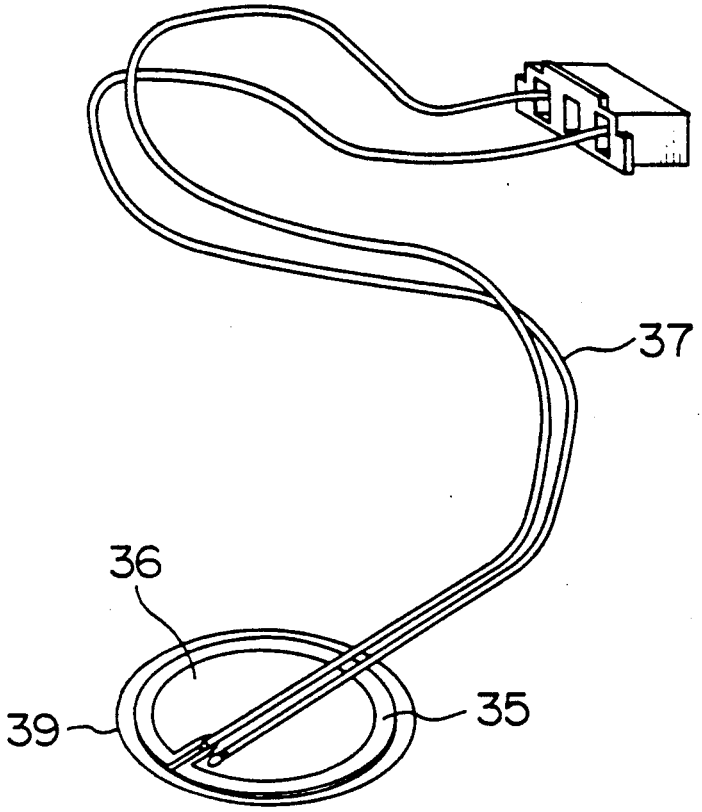
FIG. 7 is a perspective view of the embodiment shown in FIG. 6.

Referring to FIG. 6, silver-type electrodes 36 are printed on both sides of a disk-shaped ceramic piezoelectric element which serves as the pyroelectric element 35. Leads 37 are soldered to these electrodes. The pyroelectric element 35 is bonded to a metallic plate 39 by an adhesive 40. The element 35 is coated with a resin film 41 so that the charge portion of the element 35 may not be exposed.

A description will be now given of the manner of flow of the air in the region around the vapor sensor 7 and the cooling blower 18.

A vent pipe 15 communicating with the second exhaust opening 4 of the heating chamber 1 is coupled to the straight portion of the first exhaust guide 16 and the cooling blower 18 for cooling electric components such as the high-voltage transformer 19 by introducing external air and blowing the same to the region around the orifice plate 25. Thus, the cold air introduced from the outside of the apparatus moves in contact with the pyroelectric element of the vapor sensor 7 so as to cool the same. The orifice plate 25 defines a restricted passage 42 which leads to a passage 43 of a large cross-sectional area. Thus, the air flowing through the air passages experiences a large change in the cross-sectional area. The passage 43 of the greater cross-sectional area is connected to a passage having a further greater cross-sectional area which leads to the second discharge opening 28 in the outer surface of the apparatus.

The cold air from the cooling blower 18 is compelled to flow through the passage 42 of the smaller diameter and then rushes into the passage 43 of the greater cross-sectional area so as to flow therethrough at a uniform velocity The air then reaches the second discharge opening 28 while slightly reducing its energy and is discharged to the outside of the apparatus. The static pressure in the passage 42 of the smaller diameter is reduced slightly downstream of the passage 42 because of a high velocity of the downstream air. The region where the static pressure is reduced is connected to the straight portion of the first exhaust guide 16 leading from the second discharge opening 4 of the heating chamber 1, so that the vapor generated from the material 9 is quickly introduced from the heating chamber to the region where the static pressure has been lowered to a level below that in the heating chamber 1. The vapor sensor 7 is disposed in the vicinity of the region of the passage 43 having the greater cross-sectional area to which the vapor is introduced, so that the vapor sensor 7 is capable of sensing any change in the condition of the vapor caused by a change in the state of heating of the material 9. It is thus possible to obtain a heating apparatus having excellent response characteristics.

Figure 8:
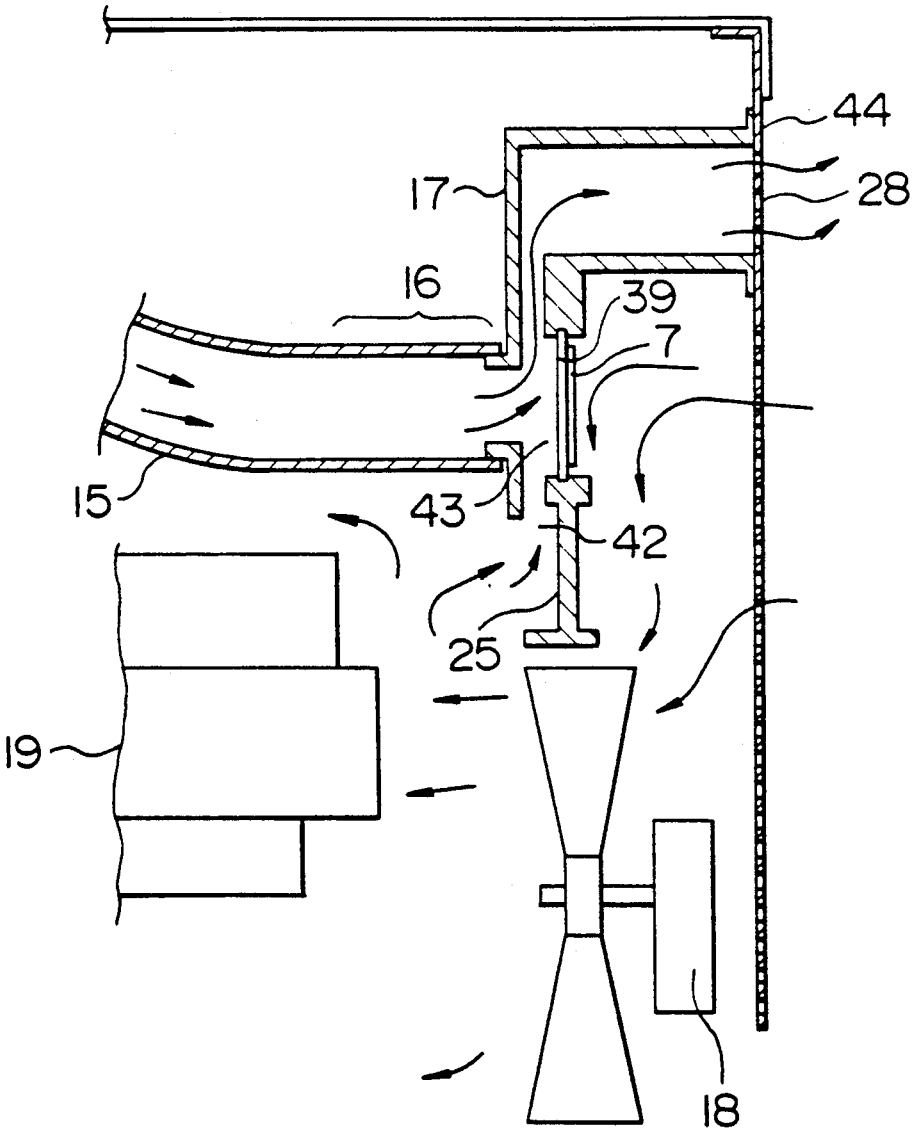
FIG. 8 is an enlarged, partial front sectional view of an embodiment of the present invention.
Figure 9:
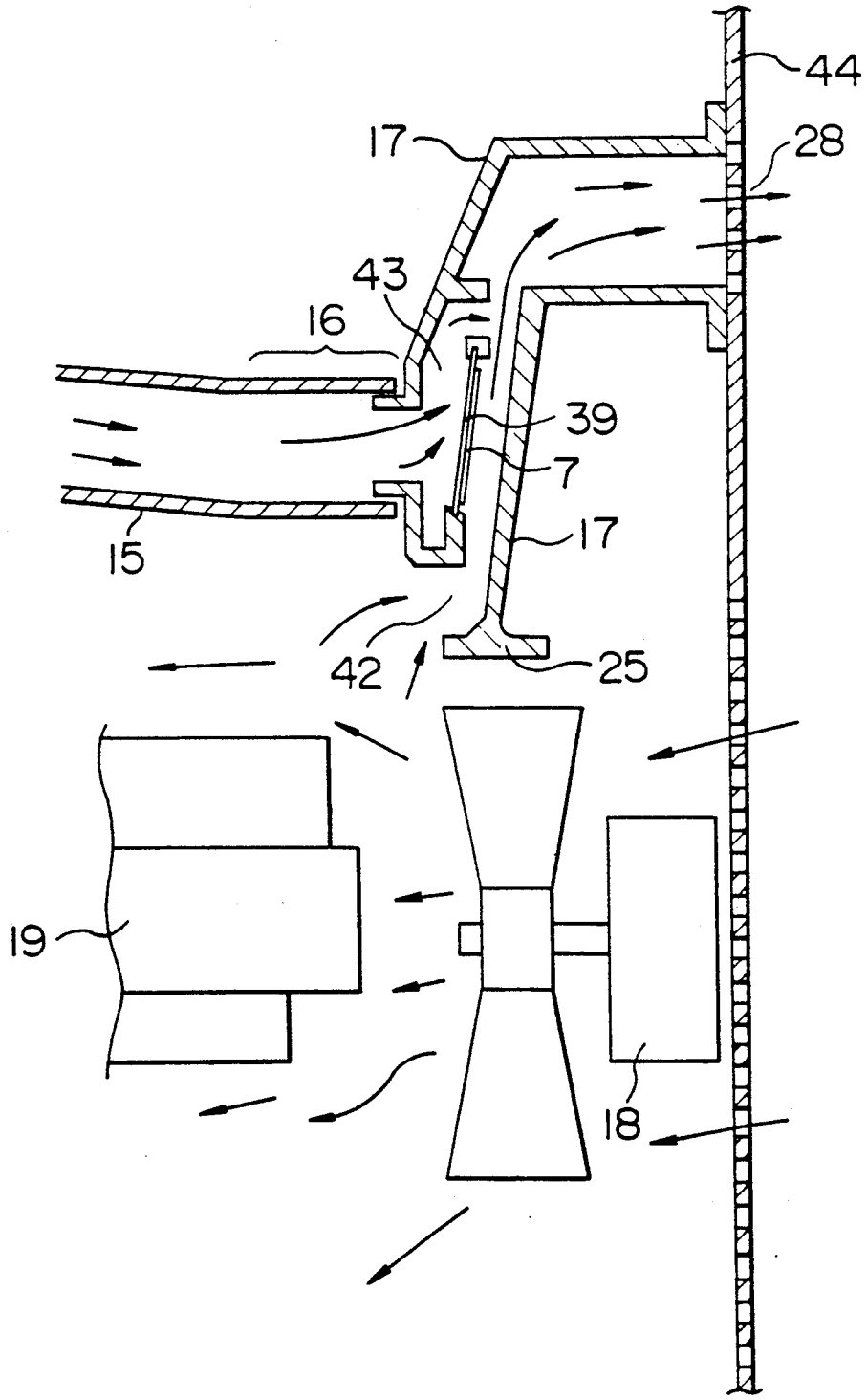
FIG. 9 is an enlarged, partial front sectional view of another embodiment of the present invention.

FIG. 9 shows a modification in which a vigorous flow of cold air is introduced from the passage 42 of the smaller cross-sectional area into the second exhaust passage of a greater cross-sectional area so that a reduced pressure is generated thereby the introduction of the vapor from the heating chamber can be promoted. In this modification, the element of the vapor sensor 7 is disposed at a position where the air flows at a high velocity. In the arrangement shown in FIG. 7, the vapor sensor 7 is cooled by the external air introduced by the blower 18. In the arrangement shown in FIG. 8, however, the vapor sensor 7 is disposed in the stream of air of high velocity so that the cooling effect is enhanced.

Figure 10:
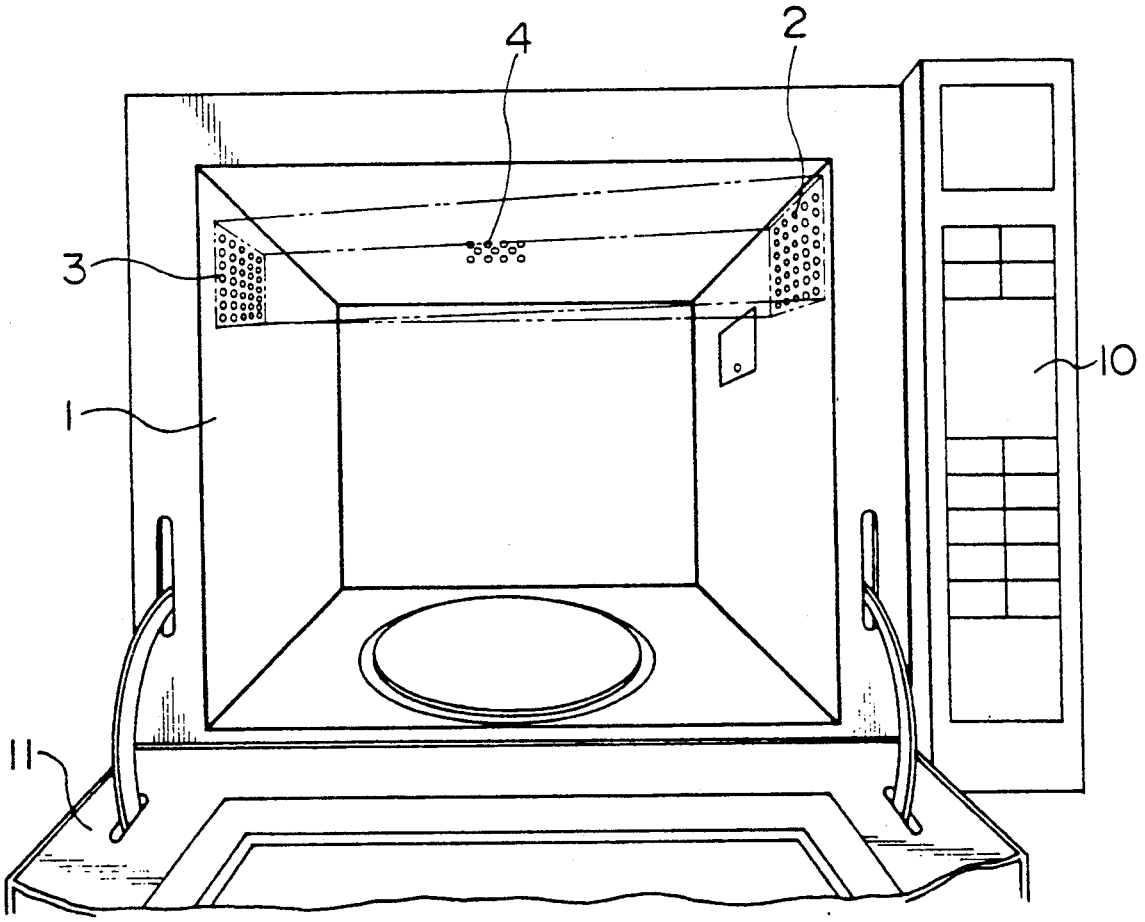
FIGS. 10 to 12 are enlarged front views of different embodiments according to the present invention.
Figure 11:
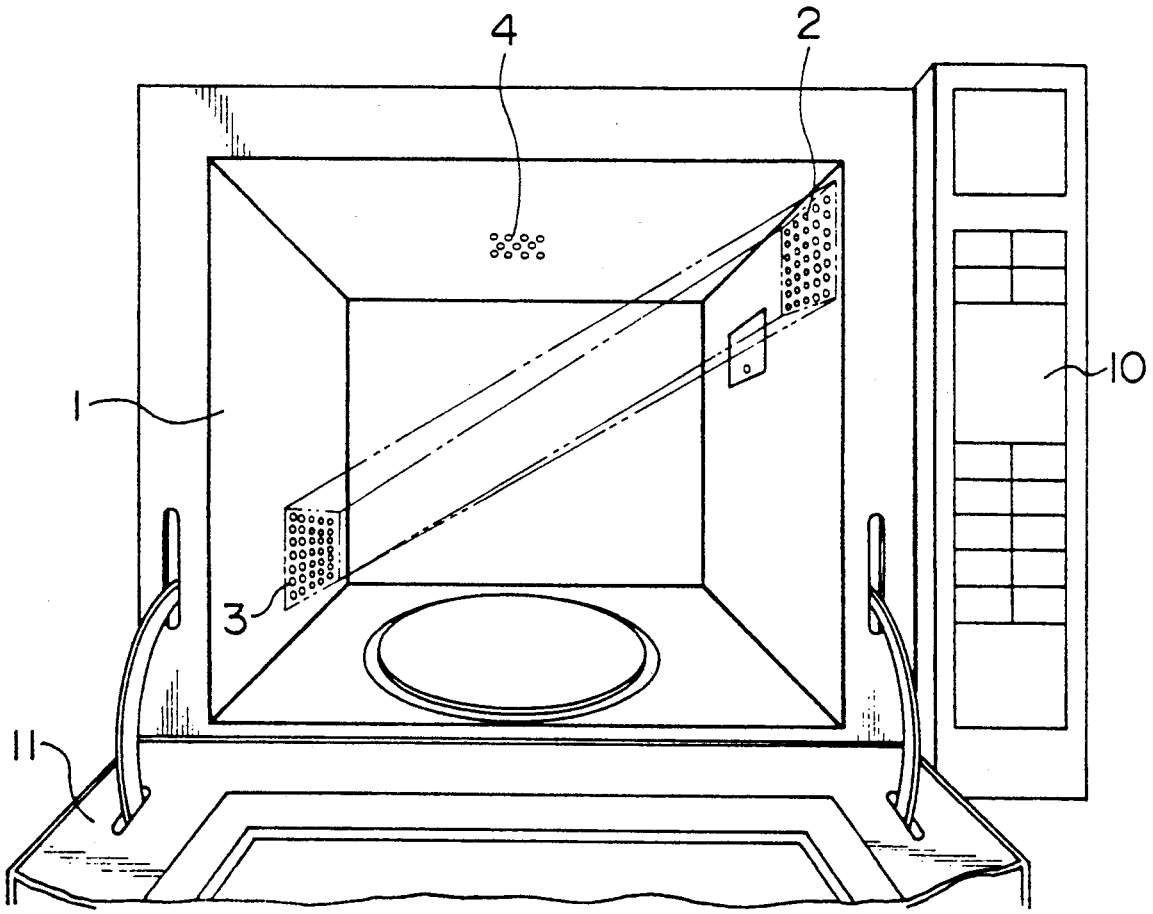
Figure 12:
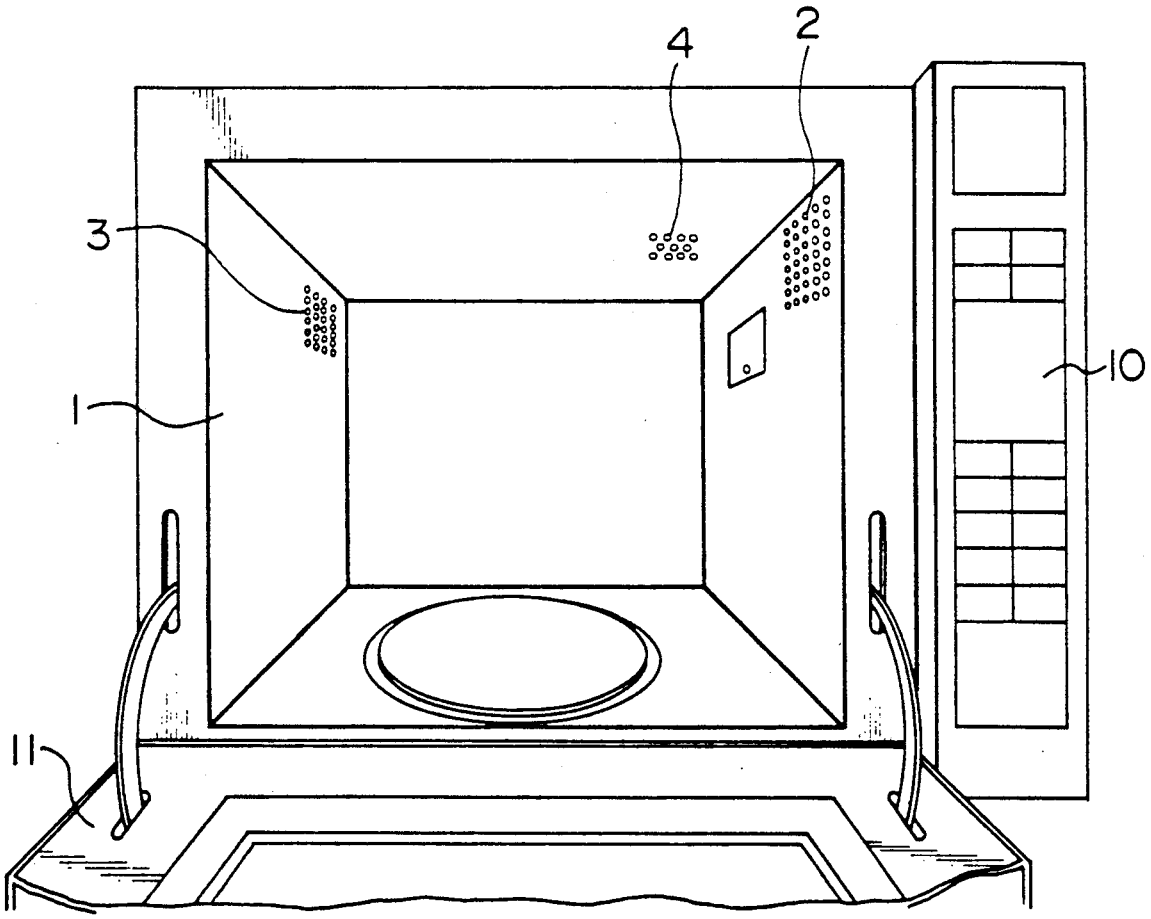

FIGS. 10 to 12 show different embodiments of the invention.

The embodiment shown in FIG. 10 is different from the preceding embodiments in that the first exhaust opening 3 is formed in the left wall of the heating chamber 1 at an upper portion of this wall adjacent to the door. Thus, the second exhaust opening 4 is provided at a level above the levels of the first exhaust opening 3 and the air supply opening 2. The first exhaust opening 3 has an area greater than that of the second exhaust opening 4. The air supplied through the air supply opening 2 flows along a wall of the heating chamber and along a window 12 and is then deflected at the juncture between this wall and the next wall so as to flow along the next wall. This flow of air is discharged to the outside of the heating chamber through the first exhaust opening 3. The second exhaust opening 4 is formed in a side wall of the heating chamber which is not reached by the above-mentioned flow of air and which opposes the wall along which the above-mentioned flow of air is formed, or in the top wall of the heating chamber.

The embodiment shown in FIG. 11 is different from the preceding embodiment in that the first exhaust opening 3 is formed in the left side wall of the heating chamber at a lower portion remote from the door. Thus, the second exhaust opening 4 is provided at a level above the levels of the first exhaust opening 3 and the air supply opening 2. The first exhaust opening 3 has an area greater than that of the second exhaust opening 4. The first exhaust opening 3 is disposed at a level below that of the air supply opening 2, while the second exhaust opening 4 is disposed at the same level as or above the air supply opening 2. The air supplied through the air supply opening 2 flows along a wall of the heating chamber and along a window 12 and is then deflected at the juncture between this wall and the next wall so as to flow along the next wall. This flow of air is discharged to the outside of the heating chamber through the first exhaust opening 3. The second exhaust opening 4 is formed in a side wall of the heating chamber which is not reached by the above-mentioned flow of air and which opposes the wall along which the above-mentioned flow of air is formed, or in the top wall of the heating chamber.

The embodiment shown in FIG. 12 is distinguished from the preceding embodiments in that the first exhaust opening 3 is formed in the left side wall of the heating chamber at an upper portion of this wall remote from the door, while the second exhaust opening 4 is formed in the top wall of the heating chamber at a right portion of this top wall remote from the door. According to this arrangement, the second exhaust opening 4 is disposed at a level above the levels of the air supply opening 2 and the first exhaust opening 3. The first exhaust opening 3 is disposed at a level below that of the air supply opening 2, while the second exhaust opening 4 is disposed at the same level as or above the air supply opening 2. The air supplied through the air supply opening 2 flows along a wall of the heating chamber and along a window 12 and is then deflected at the juncture between this wall and the next wall so as to flow along the next wall. This flow of air is discharged to the outside of the heating chamber through the first exhaust opening 3. The second exhaust opening 4 is formed in a side wall of the heating chamber which is not reached by the above-mentioned flow of air and which opposes the wall along which the above-mentioned flow of air is formed, or in the top wall of the heating chamber.

Referring to FIGS. 1, 10, 11 and 12, since the area of the first exhaust opening 3 is greater than that of the second exhaust opening 4, a large portion of the air supplied by the air supply opening 2 is discharged through the first exhaust opening 3 which has the greater cross-sectional area and, hence, which provides a smaller resistance than the second exhaust opening 4. Thus, the air supplied from the air supply opening 2 stays in the heating chamber only for a short time. This means that the diluting effect produced by the air for diluting the vapor as well as the cooling effect for cooling the vapor by the air, is conveniently reduced to preserve the temperature of the vapor reaching the vapor sensor 7 through the second exhaust opening 4, whereby the state of heating of the heated material 9 can be sensed accurately. This enables the control unit 6 to perform the heating control optimizing the state of control of the heated state of the material 9.

The first exhaust opening 3 and the second exhaust opening 4 are at different levels in the heating chamber. The air supplied from the air supply opening 2 is directed towards the first exhaust opening 3 as explained above but a small portion of the air which is not received by the first exhaust opening 3 forms a vortex flow around the first exhaust opening 3. This vortex flow of air around the first exhaust opening 3 can hardly reach the second exhaust opening 4. This means that the diluting effect produced by the air for diluting the vapor around the second exhaust opening, and the cooling effect for cooling the vapor by the air, are conveniently reduced to preserve the temperature of the vapor reaching the vapor sensor 7 through the second exhaust opening 4, whereby the state of heating of the heated material 9 can be sensed accurately. This enables the control unit 6 to effect a heating control for optimizing the state of control of the heated state of the material 9.

When the material 9 placed in the heating chamber 1 is heated in such a case that the second exhaust opening 4 would be fully closed, most of the air supplied through the air supply opening 2 is directed towards the first exhaust opening 3. A portion of air which wa not received by the first exhaust opening 3 forms a vortex flow around the first exhaust opening 3. This vortex flow of air, together with the vapor generated from the heated material 9, moves at a velocity smaller than that of the flow of the exhaust air towards a region where the air moving velocity is still lower, i.e., a region where the air is considered to stagnate. The second exhaust opening 4 is disposed in this region where the air is considered to stagnate. This region is, for example, positioned at a level above half the height of the heating chamber. Therefore, the vapor generated from the heated material 9 can quickly reach the region around the second exhaust opening 4. The state of heating of the material 9, therefore, can be sensed by the vapor sensor quickly so that the control unit 6 performs a control to realize an optimum heating condition of the material 9.

Referring to FIG. 3, the distance between the second exhaust opening 4 and the cooling blower 18 is smaller than the distance between the first exhaust opening 3 and the cooling blower 18. The vapor sensor 7 is disposed in the vicinity of the cooling blower 18 so as to be cooled by the latter. The time required for causing the vapor generated from the material 9 to reach the vapor sensor 7 is decreased as the distance between the second exhaust opening 4 and the vapor sensor 7 is decreased, so that the delay of the detection of heated state of the material 9 can be decreased correspondingly. Thus, the reduced distance between the second exhaust opening 4 and the cooling blower 18 means that the sensing of the heated state of the material 9 can be quickened. Since most of the air in the heating chamber 1 is confined to the region around the first exhaust opening 3, a comparatively high temperature is developed in this region. If this local region of higher temperature is located in the vicinity of the sensor which is sensitive to radiant heat, e.g., the vapor sensor used in the invention, the sensing of vapor temperature is hindered by the noise caused by such a heat radiation source. It is therefore desirable that the region where a higher temperature is developed is located at a position remote from the vapor sensor 7. Locating the first exhaust opening 3 at a position remote from the vapor sensor 7 is equivalent to locating the first exhaust opening 3 apart from the cooling blower 18. The interruption of the vapor gas flowing from the heated material 9 towards the second exhaust opening 4 by the flow of cold air flowing from the air supply opening 3 towards the first exhaust opening 2 can be reduced by increasing and decreasing, respectively, the distance between the first exhaust opening 3 and the cooling blower 18 and the distance between the cooling blower 18 and the second exhaust opening 4. Such an arrangement enables a quick detection of the state of heating of the material 9 by the vapor sensor 7, so that the control unit 6 can effect a heating control to optimumly heat the material 9.

What is claimed is:

1. A heating apparatus for automatically heating a material, said apparatus comprising:

a heating chamber in which a material to be heated is disposed;

vapor sensing means for sensing vapor generated from the material to be heated and for producing data corresponding to the sensed vapor, said data controlling the automatic heating of the material;

an air supply opening through which air is supplied by an air supplying means into said heating chamber;

a first exhaust opening through which air is discharged to the outside of said heating chamber; and a second exhaust opening through which vapor generated from the material is introduced to said vapor sensing means wherein said air supply opening, said first exhaust opening and said second exhaust opening are positioned selectively so that the vapor generated by the material to be heated which flows toward said second exhaust opening is not suppressed by an air stream flowing in said heating chamber from said air supply opening to said first exhaust opening.

2. A heating apparatus according to claim 1, wherein said second exhaust opening is positioned at a level above the level at which said first exhaust opening is positioned.

3. A heating apparatus according to claim 2, wherein said first exhaust opening has an area greater than that of said second exhaust opening.

4. A heating apparatus according to claim 2, wherein said vapor sensing means includes a pyroelectric element which is capable of producing a voltage signal in response to an instantaneous change in temperature, said pyroelectric element producing the data corresponding to the sensed vapor.

5. A heating apparatus according to claim 2, further comprising an air passage in communication with said second exhaust opening, wherein said vapor sensing means is disposed in said air passage through which air generated by said air supplying means flows, said air passage having suction means in a portion of said passage and downstream of which the cross-sectional area of said passage is drastically increased, said suction means being connected to said second exhaust opening and for sucking the vapor generated by the material to be heated through said second exhaust opening to said vapor sensing means.

6. A heating apparatus according to claim 5, wherein a portion of the air supplied by said air supplying means is directly introduced into said air passage.

7. A heating apparatus according to claim 6, wherein the vapor is mixed with cold air supplied through said air passage by said air supplying means in a region downstream of said suction means, where a reduced pressure is effected by said cold air, and thus mixed air makes contact with a heat-sensitive surface of said vapor sensing means.

8. A heating apparatus according to claim 7, wherein said air supplying means cools a portion of said vapor sensing means other than said heatsensitive surface.

9. A heating apparatus according to claim 1, wherein said first exhaust opening is disposed at a level below said air supply opening and said second exhaust opening is disposed at the same level or above said air supply opening.

10. A heating apparatus for automatically heating a material, said apparatus comprising:

a heating chamber defined by top and bottom walls, front and rear walls and two side walls and in which a material to be heated is disposed;

vapor sensing means for sensing vapor generated by the material to be heated and for producing data corresponding to the sensed vapor, said data controlling the automatic heating of the material;

an air supply opening through which air is supplied by an air supplying means into said heating chamber;

a first exhaust opening through which air is discharged to the outside of said heating chamber;

a second exhaust opening through which vapor generated from the material is introduced to said vapor sensing means; and a window formed in said front wall, for enabling visual observation of a state of said heating chamber; wherein air supplied into said heating chamber through said air supply opening creates a main air stream which flows along at least said front wall and then is discharged through said first exhaust opening; and said second exhaust opening is formed in one of said walls in a region which is not reached by said main air stream and which opposes the wall along which said main air stream flows.

11. A heating apparatus according to claim 10, wherein the second exhaust opening is formed in the top wall of the heating chamber.

12. A heating apparatus for automatically heating a material, comprising:

a heating chamber which is defined by top and bottom walls, front and rear walls and side walls and in which the material to be heated is disposed;

vapor sensing means for sensing vapor generated from the material to be heated so as to deliver data which corresponds to said vapor and by which said heating apparatus automatically heats the material;

an air supply opening through which air is supplied by an air supplying means into said heating chamber;

a first exhaust opening through which air is discharged to the outside of said heating chamber, said air introduced into said heating chamber creating a main air stream which flows along at least a part of said walls defining said heating chamber and reaches said first exhaust opening; and a second exhaust opening through which vapor generated from the material is introduced to said vapor sensing means, said second exhaust opening being positioned downstream of said first exhaust opening in said main air stream, whereby said vapor generated from the material to be heated and discharged from said heating chamber through said second exhaust opening is maintained at a relatively high density.

* * * * *